US008380110B2

(12) United States Patent
Yuasa

(10) Patent No.: US 8,380,110 B2
(45) Date of Patent: Feb. 19, 2013

(54) DRIVE TRANSMISSION DEVICE AND IMAGE FORMING APPARATUS

(75) Inventor: Hiroshi Yuasa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 213 days.

(21) Appl. No.: 12/781,381

(22) Filed: May 17, 2010

(65) Prior Publication Data

US 2010/0296841 A1 Nov. 25, 2010

(30) Foreign Application Priority Data

May 20, 2009 (JP) ..... 2009-122481

(51) Int. Cl.
*G03G 15/00* (2006.01)

(52) U.S. Cl. ..... 399/167

(58) Field of Classification Search ..... 399/107, 399/117, 167
See application file for complete search history.

(56) References Cited

U.S. PATENT DOCUMENTS

| | | | | |
|---|---|---|---|---|
| 6,032,008 | A * | 2/2000 | Kolodziej | 399/167 |
| 2002/0046915 | A1 * | 4/2002 | Inoue et al. | 192/48.2 |
| 2005/0023099 | A1 * | 2/2005 | Sakurai et al. | 192/35 |

FOREIGN PATENT DOCUMENTS

| | | | |
|---|---|---|---|
| JP | 04-127166 | A | 4/1992 |
| JP | 09-134094 | A | 5/1997 |
| JP | 2000-027885 | A | 1/2000 |

OTHER PUBLICATIONS

Translation of Teruhiko (JP 2000027885 A, publication date: Jan. 25, 2000).*

* cited by examiner

*Primary Examiner* — Walter L Lindsay, Jr.
*Assistant Examiner* — Frederick Wenderoth
(74) *Attorney, Agent, or Firm* — Marvin A. Motsenbocker; Mot Law, PLLC

(57) ABSTRACT

A drive transmission device includes: a driving member configured to rotate by a first electric current and having an attracting portion configured to generate magnetic force by a second electric current; a driven member having an attracted portion, the attracted portion facing the driving member and configured to be attached to the attracting portion by the magnetic force, so that the driven member integrally rotates with the driving member when the attracting portion is coupled to the attracted portion; and a controller configured to control the first electric current and the second electric current, the controller configured to apply the first electric current and then the second electric current.

19 Claims, 13 Drawing Sheets

ENLARGED VIEW OF PORTION B

DRIVE TRANSMISSION DEVICE AND IMAGE FORMING APPARATUS

CROSS REFERENCE TO RELATED APPLICATIONS

This application claims priority based on 35 USC 119 from prior Japanese Patent Application No. P2009-122481 filed on May 20, 2009, entitled "Drive transmission Device and Image Forming Apparatus", the entire contents of which are incorporated herein by reference.

BACKGROUND OF THE INVENTION

1. Field of the Invention

The invention relates to a drive transmission technique to transmit a rotational driving force to a rotator in a device such as an image forming apparatus configured to form an image on a medium.

2. Description of Related Art

A conventional image forming apparatus, such as a printer, a copy machine, a facsimile machine, or a MFP (Multi-Function Peripheral), configured to form an image on a recording medium, includes a drive transmission device for an image forming unit. The drive transmission device includes: a driven member, which is a drum flange provided at an axial end of a photosensitive drum (image carrier) and having a conical concave gear; a driving member, which is a drive shaft flange provided at an axial end of a drive shaft and having a conical convex gear configured to interlock with the conical concave gear of the drum flange; and a coupling mechanism configured to couple the conical convex gear with the conical concave gear with a biasing member such as a spring to drive the photosensitive drum to rotate with the drive shaft (for example, see Japanese Patent Application Laid-Open No. 09-134094).

SUMMARY OF THE INVENTION

In the coupling mechanism in the conventional drive transmission device, the axis of the driving member may be misaligned with the axis of the driven member because of a mesh error and/or clearance between the conical concave gear and the conical convex gear. Such a misalignment causes an eccentric rotation of the photosensitive drum and this may cause an image-forming failure.

An first aspect of the invention is a drive transmission device including: a driving member configured to rotate by a first electric current and having an attracting portion configured to generate magnetic force by a second electric current; a driven member having an attracted portion, the attracted portion facing the driving member and configured to be attached to the attracting portion by the magnetic force, so that the driven member integrally rotates with the driving member when the attracting portion is coupled to the attracted portion; and a controller configured to control the first electric current and the second electric current, the controller configured to apply the first electric current and then the second electric current.

A second aspect of the invention is an image forming apparatus including the drive transmission device according to the above aspect.

A third aspect of the invention is a method of controlling a drive transmission device, including the steps of: rotating a driving member by applying a first electric current; magnetically attaching a driven member to the driving member by applying a second electric current, after the driving member starts rotating.

In the third aspect of the invention, the second electric current may be first applied intermittently and then applied continuously at a constant level.

According to the aspect of the invention, a misalignment between the axis of the driving member and the axis of the driven member is prevented so as to eliminate eccentric rotation of the driven member.

DETAILED DESCRIPTION OF THE EMBODIMENTS

Figure 1:
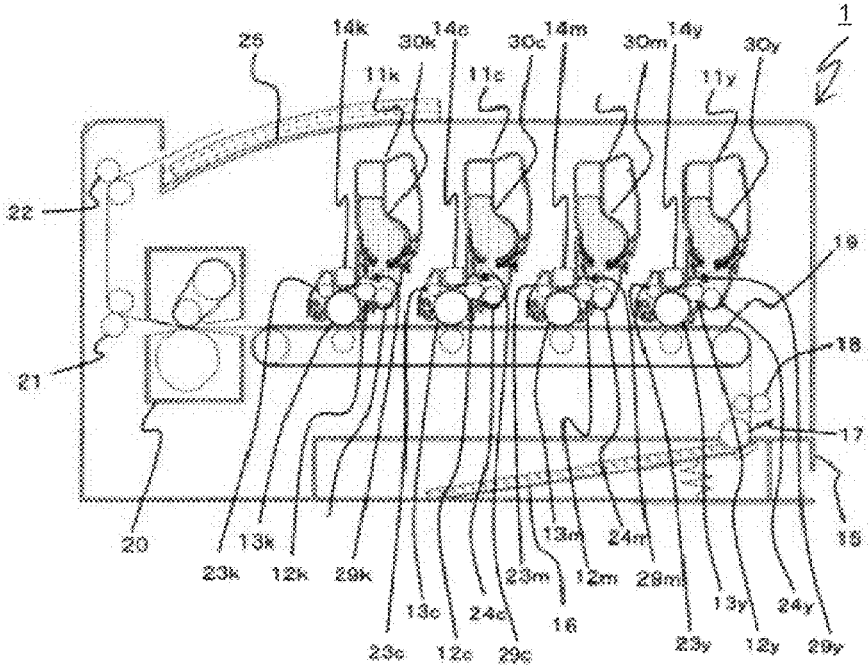
FIG. 1 is a configuration diagram of an image forming apparatus of a first embodiment.

Descriptions are provided herein below for embodiments based on the drawings. In the respective drawings referenced herein, the same constituents are designated by the same reference numerals and duplicate explanation concerning the same constituents is omitted. All of the drawings are provided to illustrate the respective examples only.

Note that although a color electrophotographic printer is described as an example of an image apparatus in the following embodiments, an image forming apparatus according to the invention may be another type of an image forming apparatus such as a printer, a copy machine, a facsimile machine, a MFP (Multi-function peripheral), or the like having a printing function.

First Embodiment

Configuration

FIG. 1 is a configuration diagram of an image forming apparatus of the first embodiment. As shown in FIG. 1, the image forming apparatus is an electrophotographic printer configured to process color-printing with four colors, using Y (yellow), M (magenta), C (cyan), and K (black) toners. Hereinafter, y, m, c, and k are attached to reference numbers to indicate respective configurations for yellow (Y), magenta (M), cyan (C), and black (K).

The image forming apparatus of the first embodiment includes image forming units 11*y*, 11*m*, 11*c* and 11*k* of the respective colors. Exposure heads 14*y*, 14*m*, 14*c*, and 14*k* are disposed adjacent to image forming units 11*y*, 11*m*, 11*c* and 11*k*, respectively, with a space therebetween.

The image forming apparatus has therein a medium transporting path extending from medium tray 15 to stacker cover 25. Media tray 15 contains therein stacked media 16 and has separation rollers 17 for separating media 16 and to feed medium 16 one by one to the medium transporting path. Disposed along the medium transporting path are conveying rollers 18; image forming units 11*y*, 11*m*, 11*c* and 11*k*; image transfer belt 19 provided opposite to the image forming units and configured to transfer, to medium 16, toner images formed by the image forming units; fixing unit 20 configured to fix the toner images to medium 16; and discharging rollers 21 and 22. Printed medium 16 is discharged from the medium transport path onto stacker cover 25.

Image forming unit 11*y*, 11*m*, 11*c*, and 11*k* contain therein toner 30*y*, 30*m*, 30*c*, and 30*k* of the respective colors. Each image forming unit 11*y*, 11*m*, 11*c*, and 11*k* includes: photosensitive drum 13*y*, 13*m*, 13*c*, and 13*k* in contact with image transfer belt 19; developing roller 12*y*, 12*m*, 12*c* and 12*k*; and charging roller 23*y*, 23*m*, 23*c*, and 23*k* in contact with photosensitive drum 13*y*, 13*m*, 13*c*, 13*k*.

Each image forming unit 11*y*, 11*m*, 11*c*, and 11*k* also includes: supply roller 24*y*, 24*m*, 24*c*, and 24*k* in contact with developing roller 12*y*, 12*m*, 12*c* and 12*k* to supply toner 30*y*, 30*m*, 30*c* and 30*k* to developing roller 12*y*, 12*m*, 12*c* and 12*k*; and development blade 29*y*, 29*m*, 29*c*, and 29*k* to form a thin layer of toner 30*y*, 30*m*, 30*c*, and 30*k* on developing roller 12*y*, 12*m*, 12*c* and 12*k*.

Figure 2:
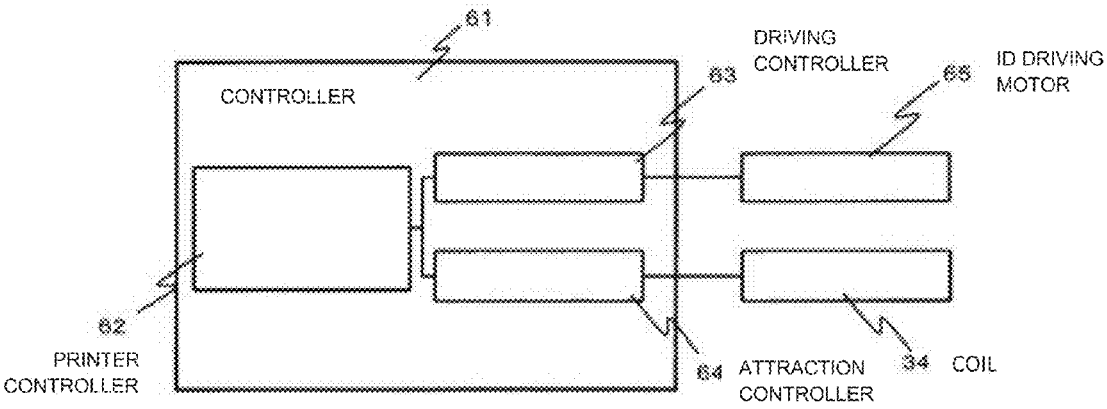
FIG. 2 is a control block diagram of the image forming apparatus of the first embodiment.
Figure 3:
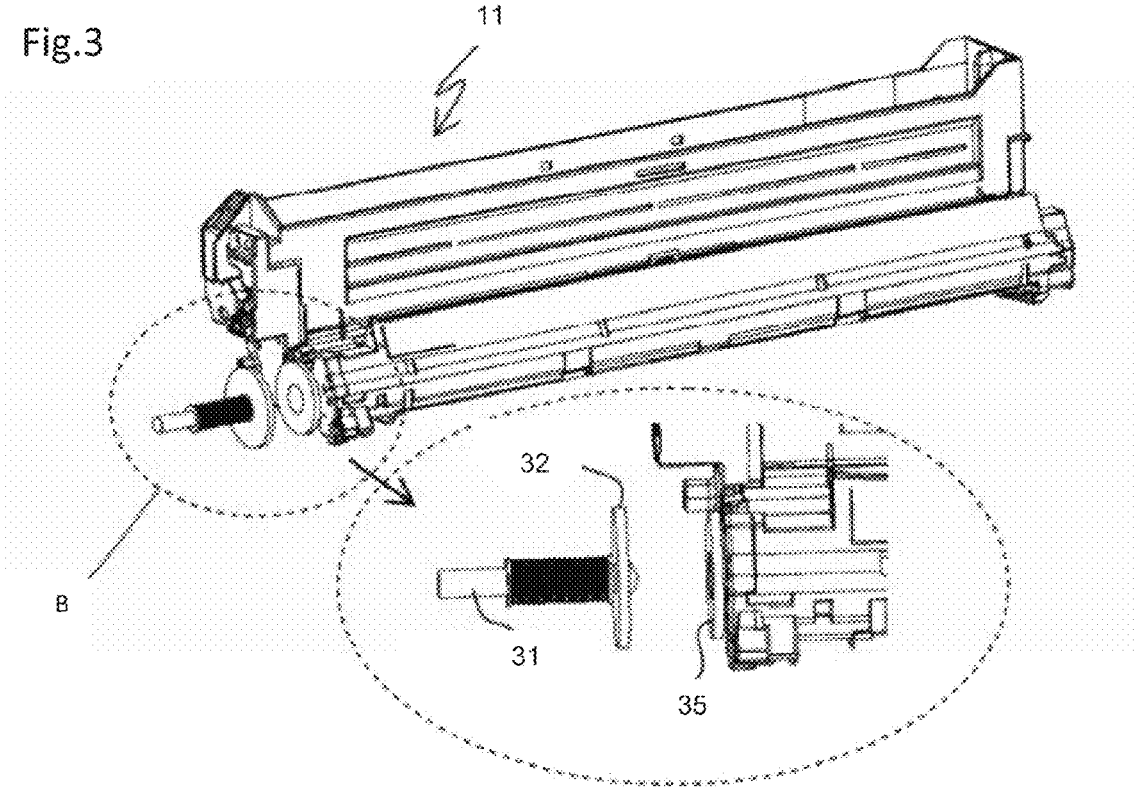
FIG. 3 is a configuration diagram of a drive transmission mechanism of an image forming unit of the first embodiment.
Figure 4:
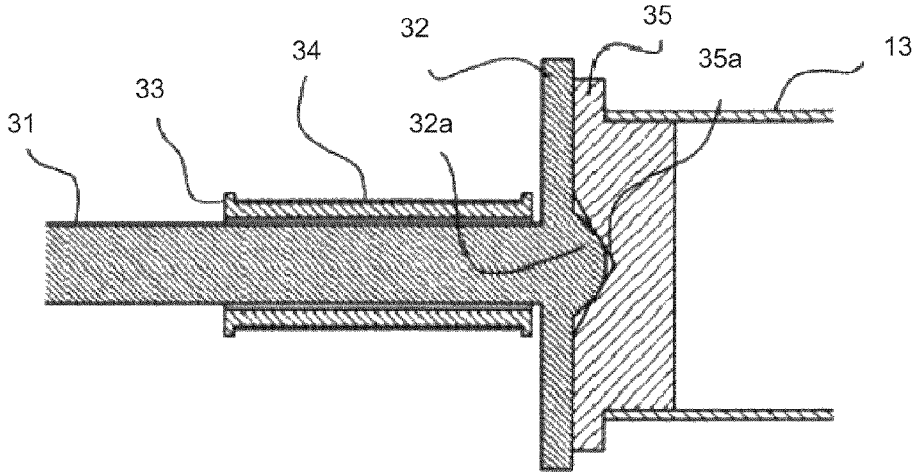
FIG. 4 is a sectional view of the drive transmission mechanism of the image forming unit of the first embodiment.
Figure 5:
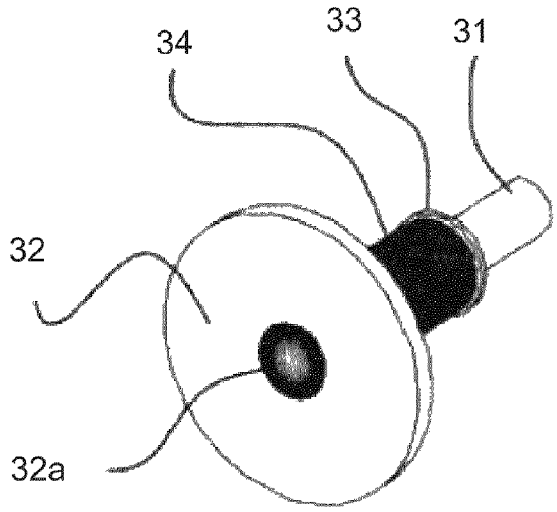
FIG. 5 is a perspective view of the driving side of the drive transmission mechanism of the image forming unit of the first embodiment.
Figure 6:
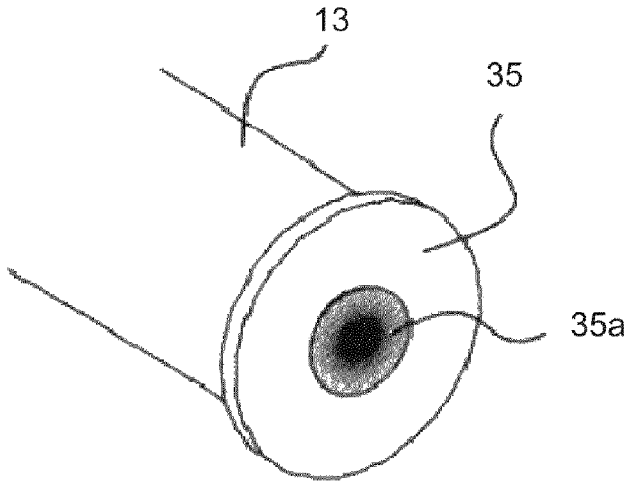
FIG. 6 is a perspective view of the driven side of the drive transmission mechanism of the image forming unit of the first embodiment.

FIG. 2 is a control block diagram of the image forming apparatus of the first embodiment. FIG. 3 is a configuration diagram of a drive transmission mechanism of image forming unit 11 of the image forming apparatus of the first embodiment. FIG. 4 is a cross section of the drive transmission mechanism for photosensitive drum 13 of the image forming apparatus of the first embodiment. FIG. 5 is a perspective view of the driving side of the drive transmission mechanism. FIG. 6 is a perspective view of the driven side (the photosensitive drum side) of the drive transmission mechanism.

Regarding the control system in the image forming apparatus, as shown in FIG. 2, controller 61 includes therein printer controller 62, drive controller 63, and attraction controller 64. Printer controller 62 executes overall control of the image forming apparatus. Drive controller 63 controls image drum driving motor 65 to drive image forming unit (which may be referred to as an image drum or an ID) based on instructions from printer controller 62. Attraction controller 64 drives coil 34 (to be described later in detail) to generate an attraction force of desired magnitude.

The configuration of a part of image forming unit 11 is illustrated in FIGS. 3 to 6. As show in FIGS. 3 to 6, drive shaft 31 is connected to the output shaft (serving as a driving source) of image drum driving motor 65 (not shown in FIG. 3) to which an electric current (a first electric current) is supplied. Drive shaft 31 includes flange 32 having a circular disk shape at the end of drive shaft 31. Bobbin 33, around which coil 24 of an insulated copper wire is wound, is provided around the drive shaft and in the vicinity of drive flange 32. Bobbin 33 is made of phenol molding compound or the like, whereas drive shaft 31 and drive flange 32 are made of a magnetic material such as an iron.

Drive flange 32 is formed with convex-shaped projection 32*a* at the center of the drive flange 32, and bobbin 33 is disposed such that there is a gap between bobbin 33 and drive shaft 31, as shown in FIGS. 4 and 5. Coil 34 is connected to attraction controller 64 such that attraction controller 64 can supply an electric current (a second electric current) to coil 34.

When supplied with the second electric current, coil 34 wound around drive shaft 31 generates an electromagnetic field through drive shaft 31 and drive flange 32, so that drive flange 32 magnetically attracts drum flange 35 which is opposite to drive flange 32.

Drum flange 35 is formed integrally with photosensitive drum 13 at an end of photosensitive drums 13 and made of a material, such as iron, that is attracted by a magnetic attraction. Conical recess 35*a* is formed on the center of drum flange 35 and faces projection 32*a* of drive flange 32. Accordingly, drive flange 32 and drum flange 35 form a coupling mechanism.

Note that drive flange 32 functions as an attracting portion, drive shaft 31 and drive flange 32 form a driving member, drum flange functions as attracted portion, and drum flange 35 and photosensitive drums 13 form a driven member.

The magnetic attraction of drive flange 32 varies depending on the value of the current flowing through coil 34. The current is set to a certain value at which coil 34 generates a magnetic attraction that is sufficient to cause the drive torque required to drive image forming unit 11 (required to rotate photosensitive drum 13).

For example, the magnetic attraction Fq is set to satisfy the formula $\eta Fq > \alpha Fd$, wherein Fd represents the rotational load for rotating the photosensitive drum including loads for other rollers and/or gears upon rotating the photosensitive drum; η represents a friction coefficient between drum flange 35 and drive flange 32; Fq represents the magnetic attraction; α (about 1.1 to 1.2, for example) represents a margin coefficient; and thus ηFq is the drive torque for frictionally driving the drum flange. Note that, for an A3-size color electrophotographic printer, the rotational load Fd may be about 0.5 N-m (that is, 5 kg-cm).

(Operation)

Figure 7:
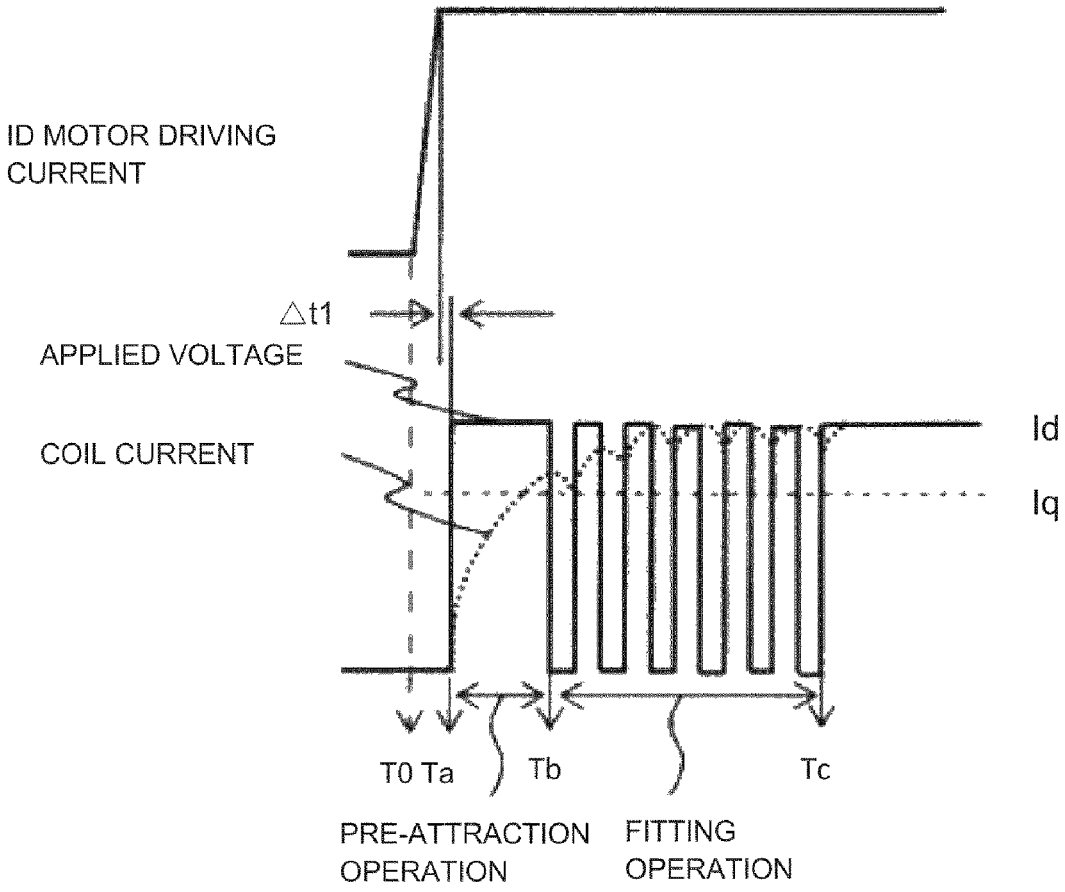
FIG. 7 is an explanatory view of the operation of a controller of the image forming apparatus of the first embodiment.
Figure 8:
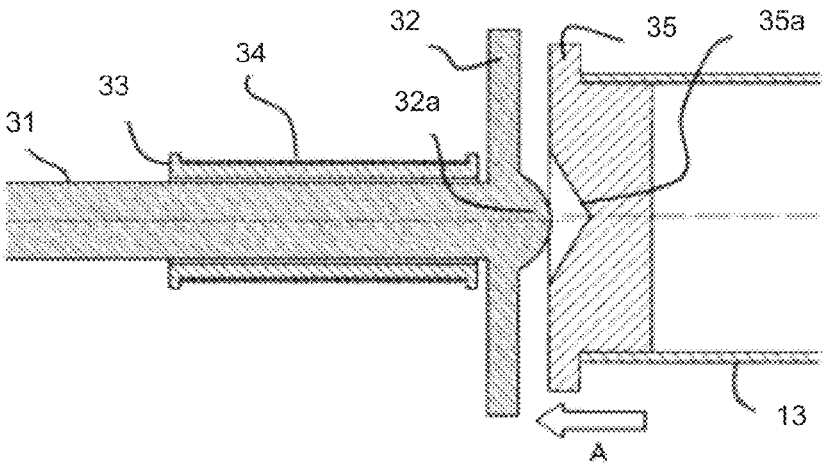
FIG. 8 is an explanatory view of a state of the drive transmission mechanism of the image forming unit of the first embodiment
Figure 9:
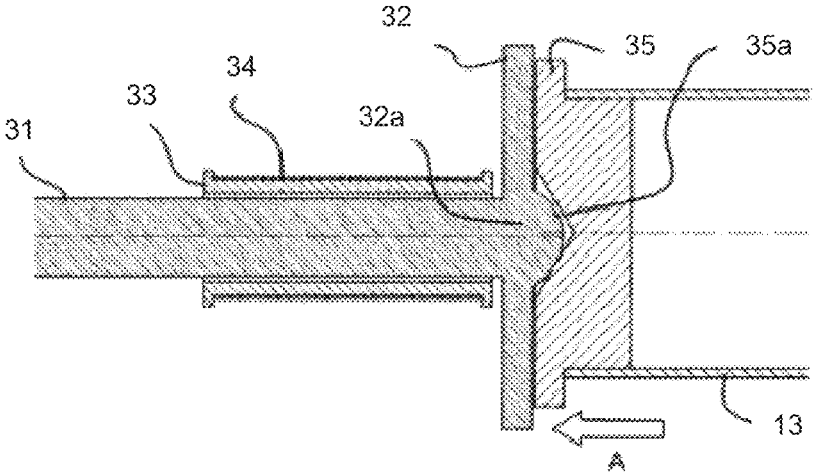
FIG. 9 is an explanatory view of a state of the drive transmission mechanism of the image forming unit of the first embodiment.
Figure 10:
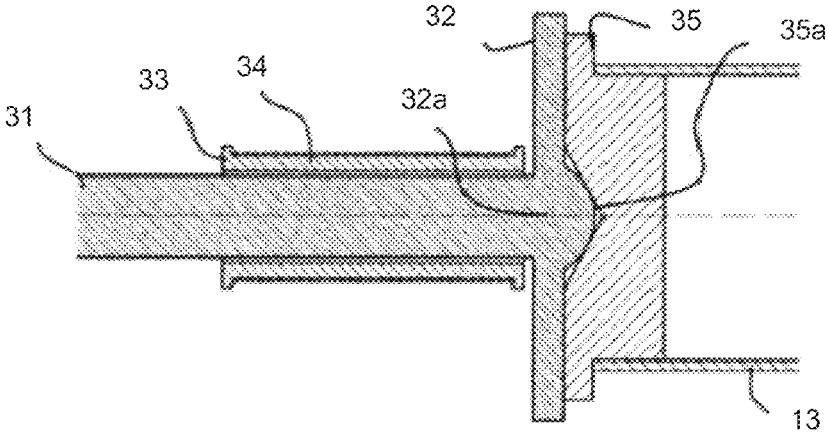
FIG. 10 is an explanatory view of a state of the drive transmission mechanism of the image forming unit of the first embodiment.

In the above configuration, the image forming apparatus of the first embodiment operates as described below. The operation of the image forming apparatus will be described in detail referring to FIGS. 1 to 10. Note that FIG. 7 is a timechart illustrating the relationship between the ID motor driving current (a current for driving image drum driving motor 65 controlled by drive controller 63), an applied voltage (a voltage applied to coil 34 controlled by attraction controller 64), and a coil current (a current flowing through coil 34). FIGS. 8 to 10 illustrate states at different times in the attraction operation of the drive transmission mechanism.

First, upon receiving a print instruction from an un-illustrated external apparatus or host apparatus, image forming apparatus 1 separates media 16 one by one with separation roller 17 to feed medium 16 to the medium transporting path and then conveys medium 16 to image transfer belt 19 with conveying rollers 18 (see FIG. 1).

At the same time, in image forming units 11*y*, 11*m*, 11*c*, and 11*k*, supply rollers 24*y*, 24*m*, 24*c*, and 24*k* are rotationally driven by image drum driving motor 65 (not shown in FIG. 1) and developing rollers 12*y*, 12*m*, 12*c*, and 12*k* are rotationally driven by image drum driving motor 65 so that toners 30*y*, 30*m*, 30*c*, and 30*k* are supplied to the surface of developing rollers 12*y*, 12*m*, 12*c*, and 12*k*.

Toners 30*y*, 30*m*, 30*c*, and 30*k* are charged and metered to a thin layer onto developing rollers 12*y*, 12*m*, 12*c*, and 12*k* by development blades 29*y*, 29*m*, 29*c*, and 29*k*. Each exposure head 14*y*, 14*m*, 14*c*, and 14*k* forms a latent image on the charged surface of photosensitive drum 13*y*, 13*m*, 13*c*, and 13*k*, which were charged by charging rollers 23*y*, 23*m*, 23*c*, and 23*k*, by irradiating with light the charged surface of photosensitive drums 13*y*, 13*m*, 13*c*, and 13*k*. The latent images are developed with toners 30*y*, 30*m*, 30*c*, and 30*k* supplied respectively from developing rollers 12*y*, 12*m*, 12*c*, and 12*k* to form toner images on photosensitive drum 13*y*, 13*m*, 13*c*, and 13*k*.

The respective toner images on photosensitive drums 13*y*, 13*m*, 13*c*, and 13*k* are transferred to medium 16 by image transfer belt 19 and then fixed to medium 16 in fixing unit 20. Such medium 16 with toner images fixed thereon are discharged to stacker cover 25 with discharging rollers 21 and 22.

Hereinafter, referring to the time chart in FIG. 7, the operation of the drive transmission mechanism of image forming unit 11 will be described. Id is the electric current value which couples drum flange to drive flange 32 in a manner such that drive shaft 31 and photosensitive drums 13 integrally rotate. Attractable current Iq is the minimum current level at which drum flange 35 can contact drive flange 32.

FIG. 8 shows a state of the drive transmission mechanism at time T0 shown in FIG. 7, time T0 being the time before the start of driving image forming unit 11.

In the state at time T0, as shown in FIG. 8, there is an initial gap between drive flange 32 and drum flange 35 and the axis of drive shaft 31 and the axis of photosensitive drum 13 may be not aligned with each other because of an attachment clearance between image forming unit 11 and the body of image forming apparatus 1 and an attachment clearance between photosensitive drum 13 and the body of image forming unit 11.

At time T0 driving controller 63 starts driving image drum driving motor 65 of image forming unit 11 to start rotating drive shaft 31, in order to form an image on medium 16. At time Ta a time interval Δt1 after a time point when the driving current of image drum driving motor 65 reached a constant value, the rotation of image drum driving motor 65 becomes stable.

At such time Ta, attraction controller 64 starts applying a constant voltage to coil 34 and continues applying it from time Ta to time Tb. Thereby the coil current gradually increases from time Ta to time Tb. At time Tb, the coil current reaches a value (attractable current level Iq+a predetermined margin) sufficiently strong to cause magnetic attraction of drum flange 35 to drive flange 32 in the direction of arrow A in FIG. 8. At time Tb, as show in FIG. 9, there is a small gap between the flat surface of drive flange 32 and the flat surface of drum flange 35 and between projection 32*a* and recess 35*a*. The operation from time Ta to time Tb is referred to as a pre-attraction operation. Note that Δt1 varies depending on the amplitude of the rotational load of photosensitive drum 13 and may be set to 100 msec, for example. Note that although drum flange 35 is configured to axially move to drive flange 32 in the direction of arrow A in FIG. 8 in this embodiment, drive flange 32 may be configured to axially move to drum flange 35 in a direction opposite to the direction of arrow A in FIG. 8 in a modification.

From time Tb to time Tc, attraction controller 64 continues turning on and off the voltage applied to coil 34 in a predetermined cycle so that the magnetic attraction of drive flange 32 gradually increases. Such on-off control is continued until the coil current value becomes stable after the coil current value reaches a certain value (driving current level Id) such that the coil generates a sufficiently-strong magnetic attraction to cause drum flange 35 to be coupled to drive flange 32 in a manner that drive shaft 31 and photosensitive drum 13 rotate integrally.

In this operation, drive flange 32 and drum flange 35 are in contact with each other and projection 32*a* and recess 35*a* are in contact with each other, as show in FIG. 10. In this state, drive flange 32 and drum flange 35 are in contact with sufficient coupling power because the opposite surface of drive flange 32 (except for projection 32*a*) and the opposite surface of drum flange 35 (except for recess 53*a*) are flat. Note that the on-off time intervals need to be fixed depending on the configurations of the components of the drive transmission mechanism and may be about 100 msec to 500 msec, for example.

As described above, drum flange 35 is gradually pulled to drive flange 32 by the on-off control of the current flowing through coil 34 and is intermittently coupled to drive flange 32. In this state (a half coupled state), slipping occurs between drum flange 35 and drive flange 32 while drum flange 35 rotates such that the rotation speed of drum flange 35 is slower than the rotation speed of drive flange 32.

In the half-coupled state, projection 32*a* of drive flange 32 and recess 35*a* of drum flange 35 are in slide contact with each other, and thus the axis of drive flange 32 and the axis of drum flange 35 are aligned with each other. This ensures that drive shaft 31 and photosensitive drums 13 are coaxially coupled with each other while rotating together.

By going through the half coupled state (intermittent coupled state), sudden impact to drum flange 35 is prevented.

This operation between time Tb and time Tc can be referred to as a fitting operation (axial alignment operation) to execute the axial alignment.

After executing the on-off control until time Tc, attraction controller 64 controls the current flowing through coil 34 to a continuous constant value that causes drive flange 32 and drum flange 35 to be completely-coupled, so that drive flange 32 and drum flange rotate together. After that, the image forming operation is executed.

Figure 11:
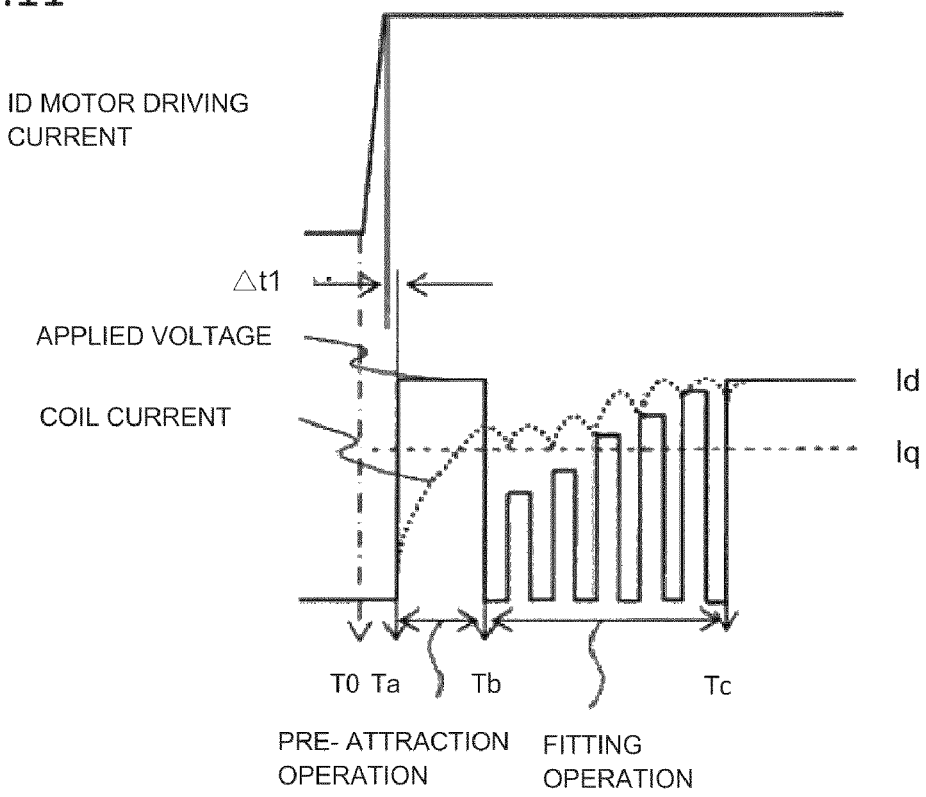
FIG. 11 is an explanatory view of the operation of the controller of the image forming apparatus according to a modification of the first embodiment.

Note that, although the first embodiment controls the current flowing through coil 34 by continually turning on and off the applied voltage in the predetermined cycle, a modification shown in FIG. 11 may be applied. The modification shown in FIG. 11 gradually increases the voltage applied to coil 34 to gradually pull photosensitive drum 13. With this operation, drive flange 32 and drum flange 35 come in contact with each other at a slower speed than in the first embodiment and sudden impact to drum flange 35 is prevented.

Although, in the first embodiment, projection 32*a* is formed on the center portion of drive flange 32 and recess 35*a* is formed on the center portion of drum flange 35, a recess may be formed on the center portion of drive flange 32 whereas a projection may be formed on the center portion of drum flange 35.

Although there is an initial gap between drive flange 32 and drum flange 35 before the start of driving image forming unit 11 in the first embodiment, drive flange 32 and drum flange 35 may be fit to each other with a bias member such as a spring before the start of driving image forming unit 11. This modification achieves the same effect as the first embodiment if the biasing force of the bias member is fixed to a value that is negligibly-smaller than the attraction force caused by attraction controller 64.

In the first embodiment the start of the pre-attraction operation (FIG. 7) between time Ta and time Tb is after the start of driving image drum driving motor 65. However, the timing of the start of driving image drum driving motor 65 can be arbitrarily set, as long as drum flange 35 is pulled to drive flange 32 in a state where the rotation of image drum driving motor 65 is stable.

For example, the following operation may be used although preparation time before the image forming operation is longer than that of the first embodiment. First, after the pre-attraction operation for drum flange 35 is executed by applying the predetermined voltage to coil 34, image drum driving motor 65 starts to be driven. Then, after the rotation of drive flange 32 becomes stable, drum flange 35 is gradually pulled by intermittently applying the voltage to coil 34 to fit drive flange 32 to drum flange 35.

Although the pre-attraction operation in the first embodiment continuously applies the voltage from time Ta to time Tb until the coil current reaches attractable current level Iq, a modified operation may intermittently apply the voltage to supply the current from time Ta to time Tc to fit drive flange 32 to drum flange 35.

Effects of First Embodiment

According to the image forming apparatus of the first embodiment as described above, a drive transmission device includes; a driving body fixed at an axial end of a drive shaft, a driven body fixed at an axial end of a rotator and facing the driving body; a concave portion provided at one of the driving body and the driven body; a convex portion provided at the other of the driving body and the driven body wherein the convex portion and the concave portion are configured to fit to each other; a rotational drive controller operable to control rotation of the driving body by a first electric current; and an attraction controller operable to intermittently control a second electric current to generate a magnetic field to attract and fit the driven body to the driving body. Accordingly, the drive transmission device can correct a misalignment between the axis of the driving side (the drive shaft) and the axis of the driven side (the rotator). This eliminates eccentric rotation and absorbs a sudden load change at the beginning of rotation.

Second Embodiment

Configuration

Figure 12:
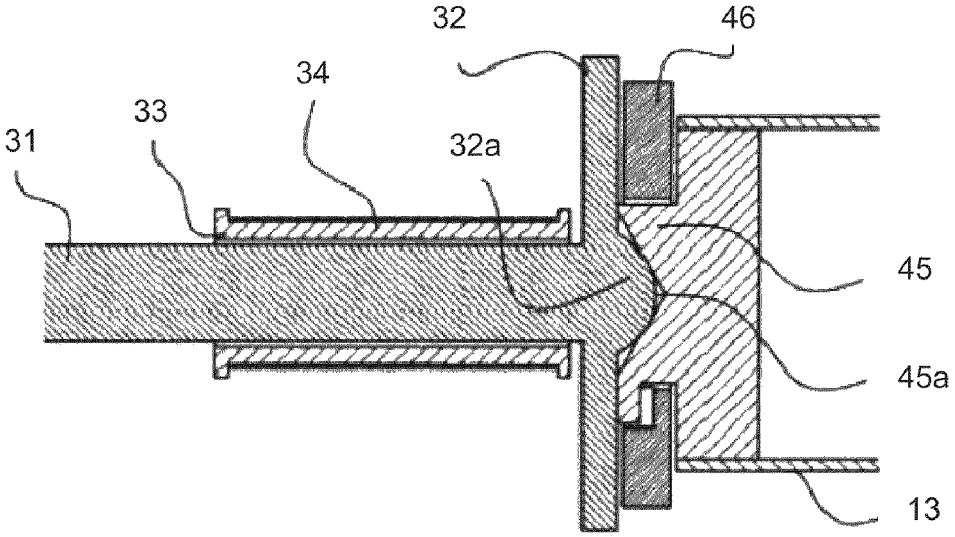
FIG. 12 is a sectional view of the driving side of a drive transmission mechanism of an image forming unit of a second embodiment.
Figure 13:
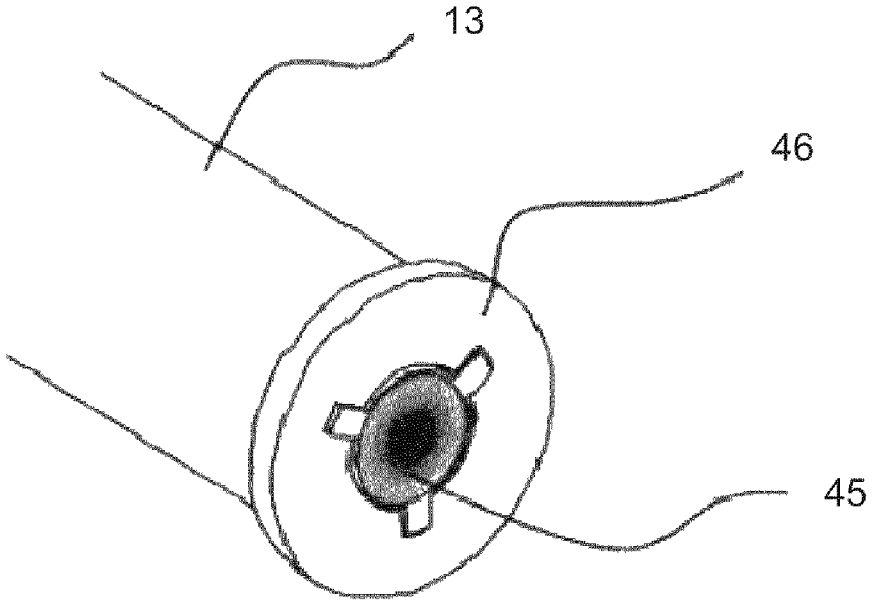
FIG. 13 is a sectional view of the driven side of the drive transmission mechanism of the image forming unit of the second embodiment.

The configuration of an image forming apparatus of a second embodiment will be described with reference to FIGS. 12 and 13. FIG. 12 is a sectional view of a drive transmission mechanism of an image forming unit of the image forming apparatus. FIG. 13 is an outline view of a flange portion of photosensitive drum 13 of the drive transmission mechanism.

The image forming apparatus of the second embodiment has drum fixed flange 45 and movable flange 46, instead of drum flange 35 of the first embodiment. Like drum flange 35 of the first embodiment, drum fixed flange 45 is made of a material, such as an iron, that is attracted by a magnetic field. Drum fixed flange 45 is integrally formed with photosensitive drums 13 and has conical recess 45*a* at the center portion.

Like drum fixed flange 45, movable flange 46 is made of a material, such as an iron, that is attracted by a magnetic field. Movable flange 46 is provided between drum fixed flange 45 and photosensitive drums 13. Movable flange 46 is axially movable with respect to drum fixed flange 45 within a predetermined gap and is rotationally fixed to drum fixed flange 45.

Note that like the first embodiment, in the second embodiment drive flange 32 functions as an attracting portion, drive shaft 31 and drive flange 32 form a driving member, movable flange 46 and drum fixed flange 45 function as an attracted portion, and movable flange 46, drum fixed flange 45, and photosensitive drums 13 form a driven member.

(Operation)

In this configuration, the image forming apparatus of the second embodiment operates as described below. Note that controller 61 operates in the same way as the operation shown in the timechart of FIG. 7 or 11, like in the first embodiment. Detail description of the timechart will be omitted for simplification.

In the image forming apparatus of the second embodiment, a fitting operation (coaxial-aligning operation) between time Tb and Tc is executed by causing drum fixed flange 45 to be in contact with drive flange 32; and the coupling operation after time Tc is executed by causing drum fixed flange 45 and movable flange 46 to be in contact with drive flange 32 so as to couple drive flange 46 with the drum flange (45, 46) in a manner that photosensitive drum 13 rotates integrally with drive shaft 31.

That is, a magnetic attraction of drive flange 32 in the fitting operation (axial-aligning operation) between time Tb and time Tb is set to such a sufficient value that drum fixed flange 45 is attracted to and attached to drive flange 32 but movable flange 46 is not attached to drive flange 32 so that drive shaft 31 and photosensitive drum 13 do not rotate integrally with each other.

Figure 14:
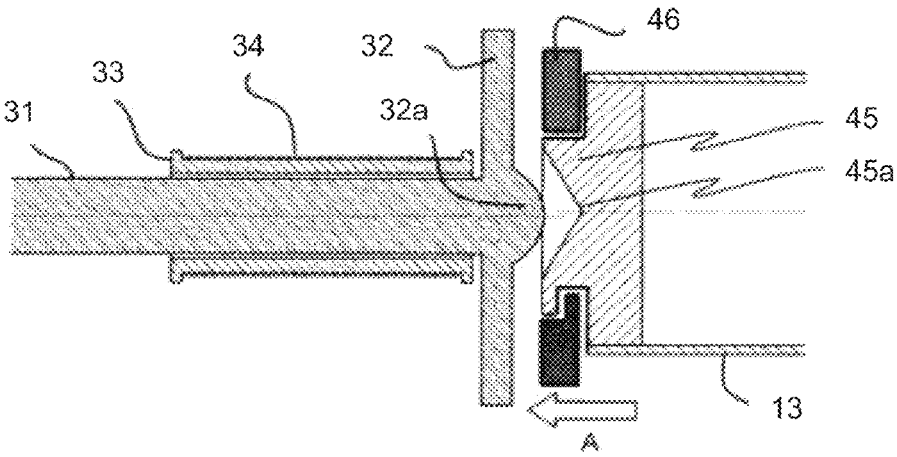
FIG. 14 is an explanatory view of a state of the drive transmission mechanism of the image forming unit of the second embodiment.

First, attraction controller 64 starts executing a pre-attraction operation at time T0 when the drive transmission mechanism is in the initial state shown in FIG. 14.

Figure 15:
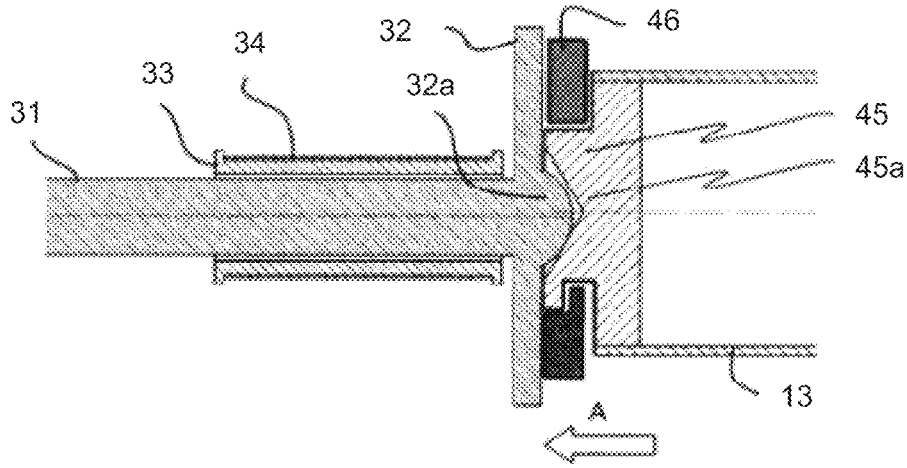
FIG. 15 is an explanatory view of a state of the drive transmission mechanism of the image forming unit of the second embodiment.

After the pre-attraction operation, attraction controller 64 executes a fitting operation (axial alignment operation) between time Ta and time Tb. In the fitting operation of applying variable current caused by the intermittent voltage to coil 34, recess 45*a* of drum fixed flange 45 is in contact with projection 32*a* of drive flange 32 as shown in FIG. 15, but movable flange 46 is not completely in contact with drive flange 32. That is, in the fitting operation, an area of the contact between drive flange 32 and the drum flange (45, 46) is not large enough to generate enough friction therebetween to integrally rotate drive shaft 31 and photosensitive drum 13. Accordingly, slipping occurs at the contact between drive flange 32 and the drum flange (45, 46). That is, in the fitting operation, the drive transmission mechanism is in a half coupled state like the first embodiment. In the half coupled state, a misalignment between the axis of drive shaft 31 and the axis of photosensitive drum 13 is eliminated.

Figure 16:
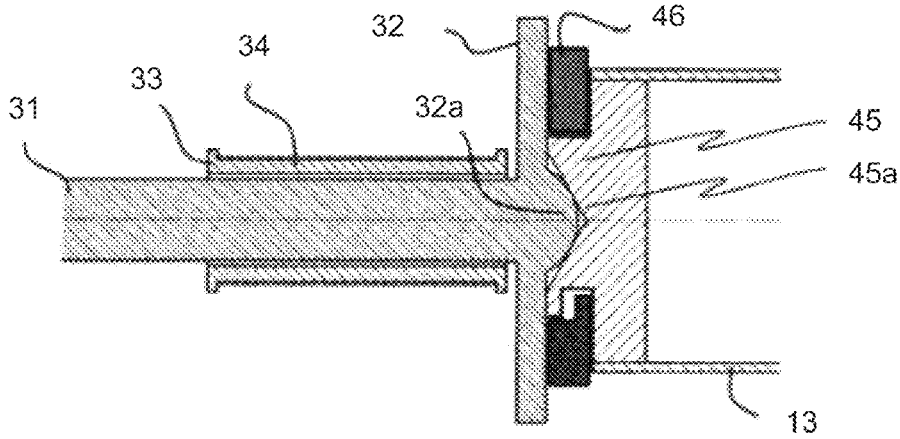
FIG. 16 is an explanatory view of a state of the drive transmission mechanism of the image forming unit of the second embodiment.

Next, at Time Tc, attraction controller 64 controls the current flowing through coil 34 to a predetermined value to completely couple drive flange 32 and the drum flange (45, 46). With this operation, movable flange 46 as well as drum fixed flange 45 are coupled to drive flange 32 as shown in FIG. 16 such that photosensitive drum 13 rotates integrally with drive shaft 13 while being coaxially aligned with drive shaft 13. Note that movable flange 46 is not rotationally movable with respect to drum fixed flange 45, so that photosensitive drum 13 can be stably rotated.

Note that although movable flange 46 is configured to be axially movable with respect to drum fixed flange 45 between drum fixed flange 45 and photosensitive drums 13 before the start of driving image forming unit 11 in the second embodiment, movable flange 46 may be biased by a bias member such as a spring. In this case, a bias force of the bias member should be set to a value negligibly-weaker than the attraction force generated by attraction controller 64.

Effect of Second Embodiment

As described above, the image forming apparatus of the second embodiment includes: a drive flange having a projection at the center portion of the drive flange; a drum fixed flange made of magnetic material and formed integrally with a photosensitive drum and having a conical recess at the center portion of the drum fixed flange; and a movable flange made of magnetic material and provided around the drum fixed flange and rotationally fixed with respect to the drum fixed flange and axially movable with respect to the drum fixed flange within a predetermined range, wherein the drum fixed flange and the movable flange separately contact with the drive flange. Accordingly, the second embodiment further improves the axial alignment to high accuracy.

Third Embodiment

Configuration

Figure 17:
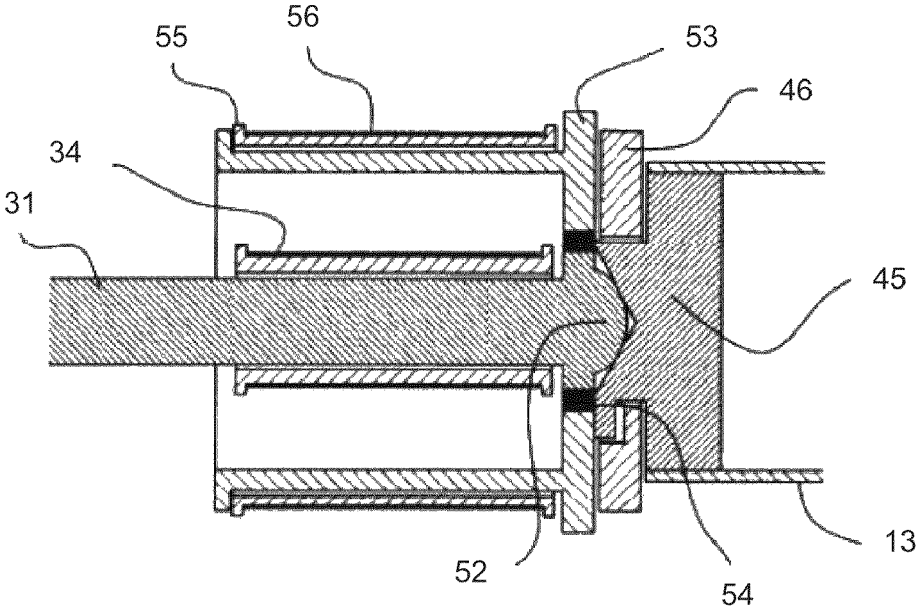
FIG. 17 is a sectional view of the driving side of a drive transmission mechanism of an image forming unit of a third embodiment
Figure 18:
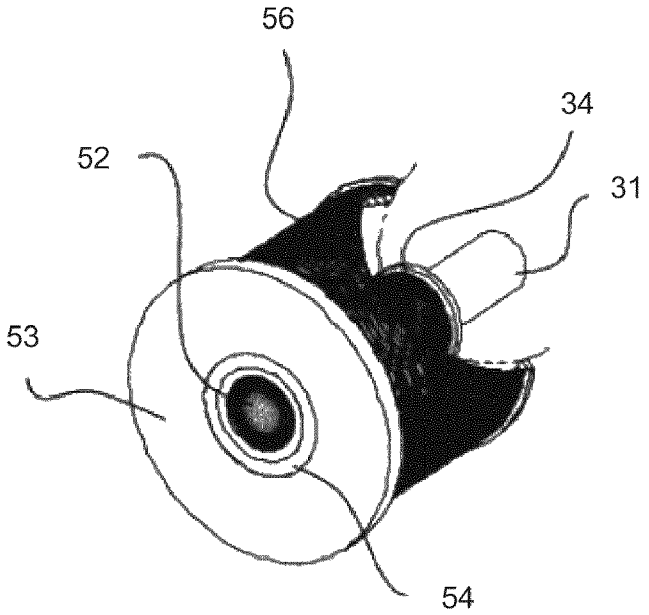
FIG. 18 is an outline view of a flange portion of a drive shaft of the image forming unit of the third embodiment.

FIG. 17 is a sectional view of a drive transmission mechanism of an image forming unit of an image forming apparatus of the third embodiment. FIG. 18 is an outline view of a drive flange of drive shaft 31.

In the image forming apparatus of the third embodiment, the drive flange is divided into drive flange projection 52 and drive flange planar portion 53. Drive flange projection 52 and drive flange planar portion 53 are fixed to each other with nonmagnetic sleeve 54 provided therebetween.

Bobbin 55, around which coil 53 is wound, is provided around an external cylinder of drive flange planar portion 53 with a gap therebetween. Coil 56 is electrically connected to attraction controller 64 such that an electric current flowing through coil 56 is controlled by attraction controller 64. When electric current flows through coil 56, coil 56 around drive flange planar portion 53 generates an electromagnetic field such that drive flange planar portion 53 attracts movable flange 46.

Bobbin 33 and drive shaft 31 are provided inside the external cylinder of drive flange planar portion 53, as in the first and second embodiments. Bobbin 33, around which coil 34 is wound, is provided around drive shaft 31. Coil 34 is electrically connected to attraction controller 64 such that an electric current flowing through coil 34 is controlled by attraction controller 64. When electric current flows through coil 34, coil 34 around drive shaft 31 generates an electromagnetic field such that drive flange projection 52 attracts drum fixed flange 45.

Note that in the third embodiment, drive flange projection 52 and drive flange planar portion 53 function as an attracting portion, drive shaft 31, drive flange projection 52, and drive flange planar portion 53 function as a driving member. Also in the third embodiment, like the second embodiment, movable flange 46 and drum fixed flange 45 function as an attracted portion, and movable flange 46, drum fixed flange 45, and photosensitive drums 13 function as a driven member.

With this configuration, the magnetic attraction of movable flange 46 caused by supplying current through coil 56 and attraction of drum fixed flange 45 caused by supplying current through coil 34 are separately controlled.

(Operation)

Figure 19:
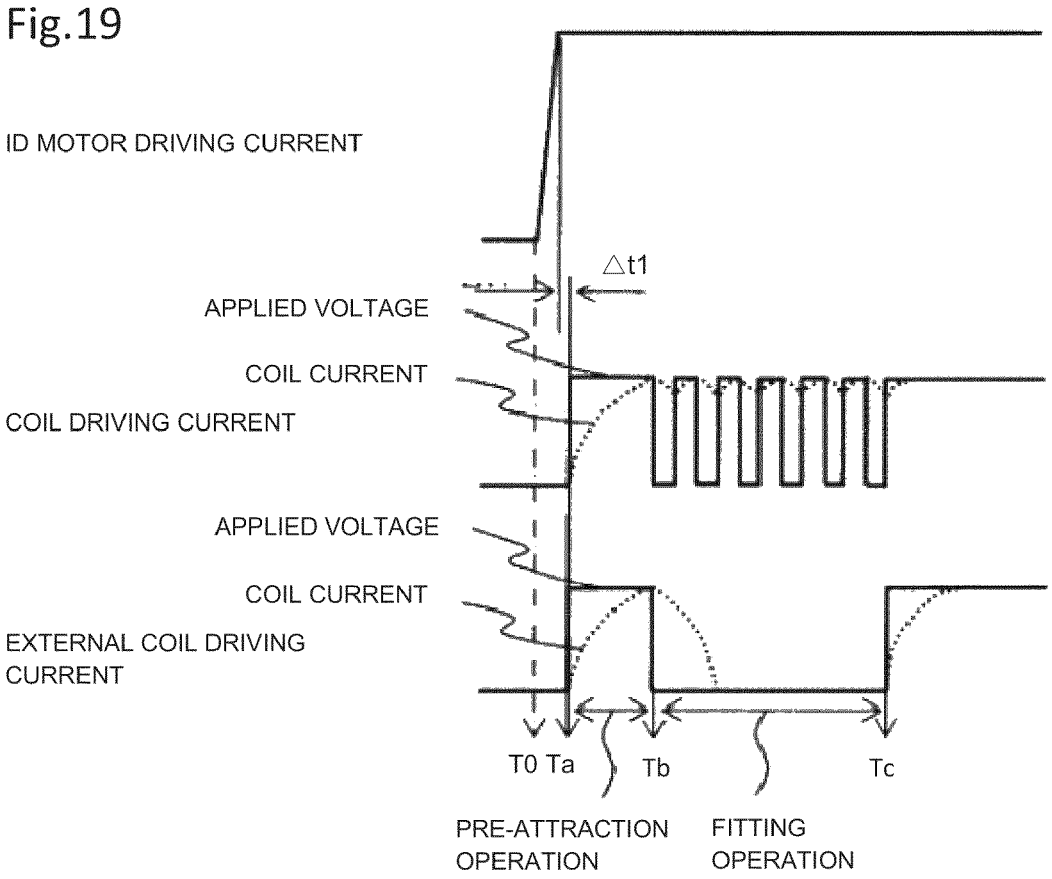
FIG. 19 is an explanatory view of the operation of a controller of the image forming apparatus of the third embodiment.
Figure 20:
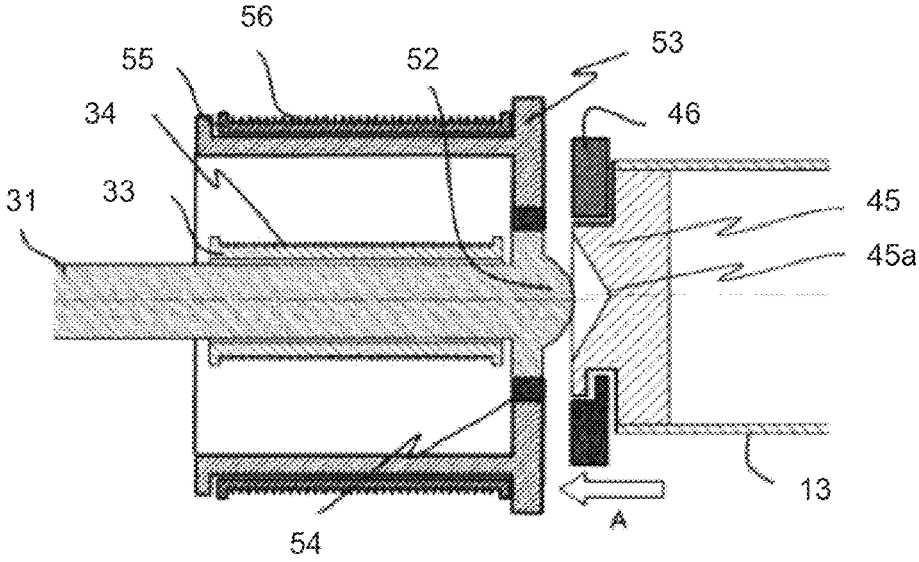
FIG. 20 is an explanatory view of a state of the drive transmission mechanism of the image forming unit of the third embodiment.
Figure 21:
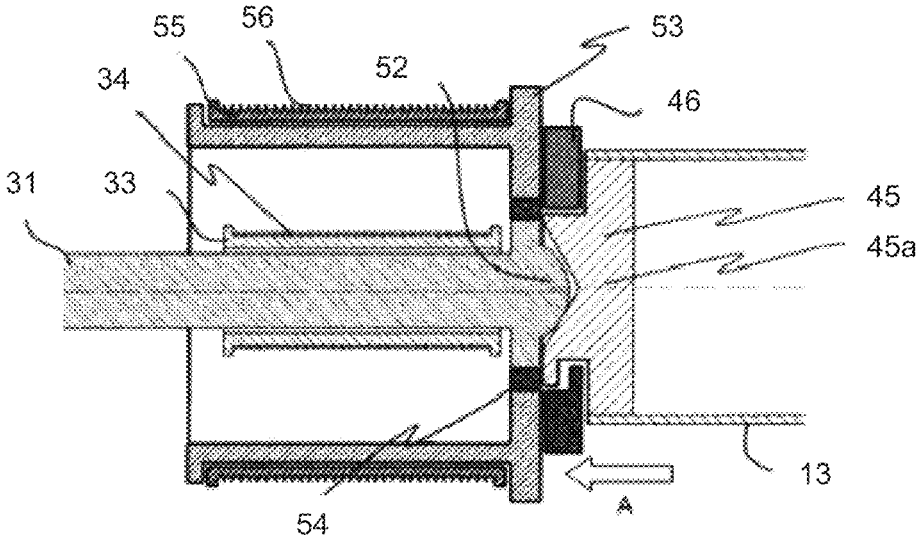
FIG. 21 is an explanatory view of a state of the drive transmission mechanism of the image forming unit of the third embodiment.
Figure 22:
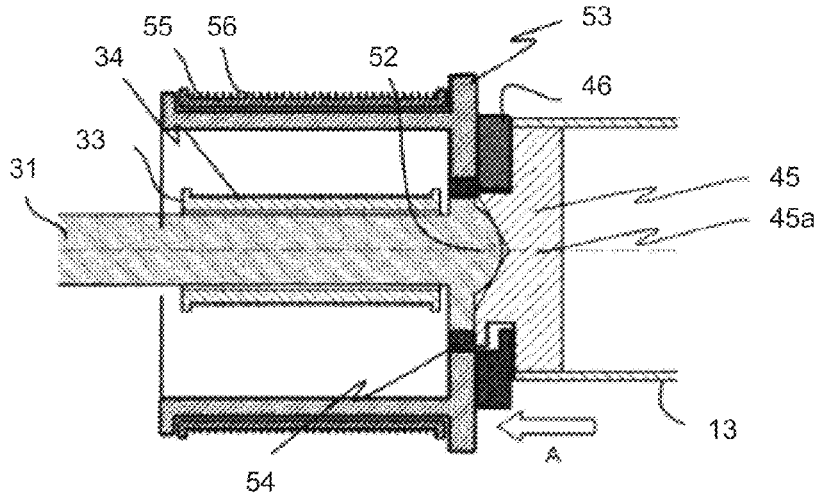
FIG. 22 is an explanatory view of a state of the drive transmission mechanism of the image forming unit of the third embodiment.

With this configuration, the image forming apparatus of the third embodiment operates as described below. The operation will be described with reference to FIGS. 19 to 22. FIG. 19 is a timechart of operation of a controller of the image forming apparatus, and FIGS. 20 to 22 are explanatory views of states of the drive transmission mechanism. Note that in the timechart of FIG. 19, the uppermost wave illustrates an ID motor driving current, waves at the middle relate to a current (coil driving current) flowing through coil 34, and the lowermost waves relate to a current (external coil driving current) flowing through coil 56.

First, attraction controller 64 executes a pre-attraction operation from time Ta to Tb by applying predetermined constant voltages to coil 34 and coil 56, respectively. With this operation, the current flowing through coil 34 and the current flowing through external coil 56 gradually increase, respectively, so that a magnetic attraction force of drive flange projection 52 and a magnetic attraction force of drive flange planar portion 53 gradually increase, respectively. Accordingly, drum fixed flange 45 and movable flange 45 are gradually attracted in the direction of arrow A in FIG. 20 from a state shown in FIG. 20. When the total magnetic attraction force exceeds a certain value, drum flange 45 and movable flange 46 are coupled to drive flange projection 52 and drive flange planar portion 53 such that photosensitive drum 13 rotates with drive shaft 13 as shown in FIG. 22.

Next, attraction controller 64 executes a fitting operation (axial-aligning operation) between time Tb to Tc by stopping to apply the voltage to external coil 56 while starting to apply a periodic intermittent voltage to coil 34. In the fitting operation between time Tb to Tc, since no voltage is applied to external coil 56, a magnetic attraction force between the drive flange (52, 53) and the drum flange (45, 46) does not couple the drive flange (52, 53) with the drum flange (45, 46) to integrally rotate photosensitive drum 13 and drive shaft 31, so that slipping occurs between the drive flange (52, 53) and the drum flange (45, 46) in the rotational direction in a manner that the rotational speed of photosensitive drum 13 is slower than the rotational speed of drive shaft 31. In such a fitting operation, the periodic intermittent voltage application to coil 34 causes variation of the magnetic attraction force between the drive flange (52, 53) and the drum flange (45, 46), so that a misalignment between the axis of drive shaft 31 and the axis of photosensitive drum 13 are removed while the state shown FIG. 21 and the state shown FIG. 22 alternatively occur.

Then, attraction controller 64 executes a coupling operation at time Tc. Specifically, at time Tc, attraction controller 64 applies constant voltages to external coil 56 and coil 34 to generate the magnetic attraction force of drive flange planar portion 53 as well as the magnetic attraction force of drive flange projection 52. With this operation, movable flange 46 is further pulled in the direction of arrow A as shown in FIG. 22 and coupled with drive flange planar portion 53. Therefore, the drive flange (52, 53) and the drum flange (45, 46) are coupled with each other in a manner that drive shaft 31 and photosensitive drum 13 rotate integrally while being coaxially-aligned with each other. This brings about stable driving of image forming unit 11

Effect of Third Embodiment

According to the image forming apparatus of the third embodiment as described in detail above, contact between projection 52 of the drive flange and recess 45*a* of drum fixed flange 45 and contact between drive flange planar portion 53 and movable flange 46 are separately controlled. Accordingly, the misalignment between the axises is corrected with higher accuracy.

[Other Modification]

Although the invention is applied to the drive of photosensitive drums 13 in the above embodiments, the invention may be applied to the drive of developing roller 12 of image forming unit 11.

Figure 23:
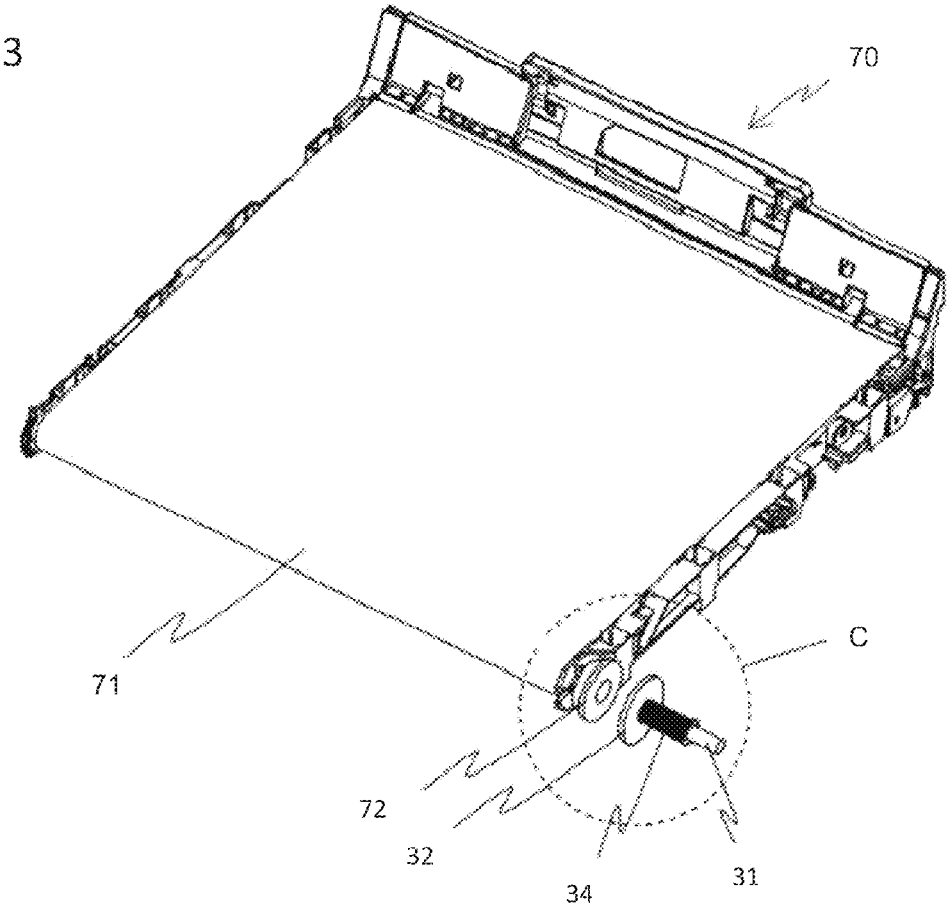
FIG. 23 is an explanatory view of a modification of the image forming apparatus according to the invention.
Figure 24:
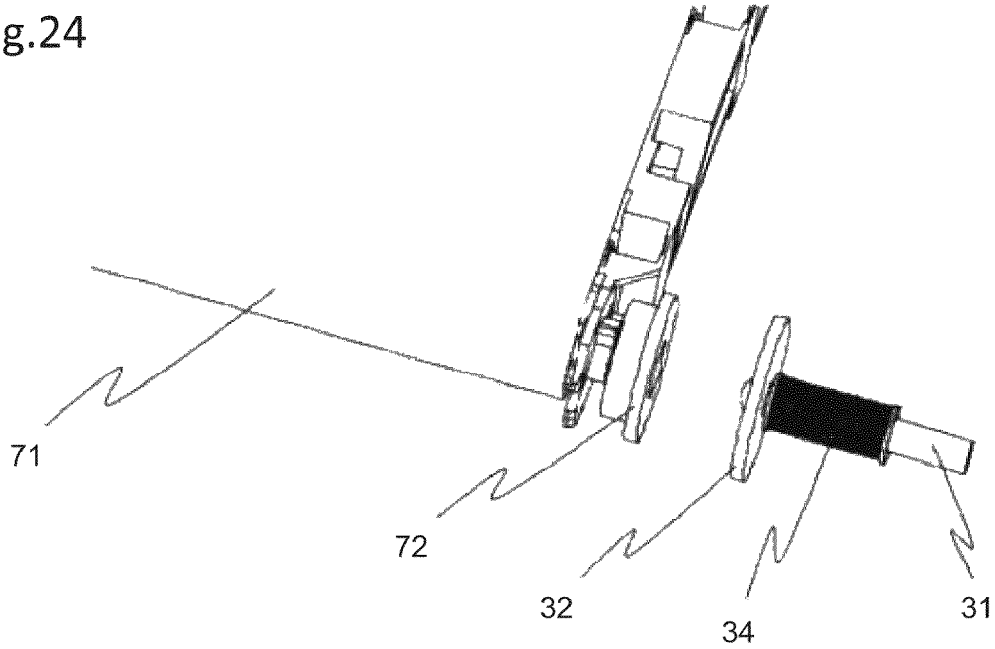
FIG. 24 is an enlarged view of portion C in FIG. 23.

Also, the invention may be applied to the drive of image transfer belt flange 72 of image transfer belt 71 in image transfer belt unit as shown in the C portion in FIG. 23 and FIG. 24 showing an enlarged view of the C portion in FIG. 23. In this case, the configuration of a driving member is the same as the configuration shown in FIG. 5 and the configuration of a driven member is the same as the configuration shown in FIG. 6; that is, image transfer belt flange 72 corresponds to drum flange 35 in FIGS. 5 and 6.

Also, drive flange 32 and image transfer belt flange 72 may have the same configuration as those shown in FIG. 12 of the second embodiment or FIG. 17 of the third embodiment.

As described above, the invention can be widely applied to an image forming apparatus, such as a printer, a copy machine, a facsimile machine or a MFP (Multi-functional Peripheral), which is configured to rotationally drive a roller member and execute printing on a recording medium.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A drive transmission device comprising:

a driving member configured to rotate by a first electric current and having an attracting portion configured to generate magnetic force by a second electric current;

a driven member having an attracted portion, the attracted portion facing the driving member and configured to be attached to the attracting portion by the magnetic force, so that the driven member integrally rotates with the driving member when the attracting portion is coupled to the attracted portion; and a controller configured to control the first electric current and the second electric current, the controller configured to apply the first electric current to rotate the driving member and the second electric current after the driving member starts rotating, wherein the second electric current includes: a first time period in which the second electric current is a continuous, substantially constant current; and a second time period in which the second electric current is a variable current caused by an intermitted voltage.

2. The drive transmission device according to claim 1, wherein the attracting portion and the attracted portion have opposed faces, respectively, the opposed faces having fit portions configured to fit to each other while aligning the axis of the drive member and the axis of the driven member.

3. The drive transmission device according to claim 2, wherein the fit portion of the attracting portion is provided at the axis of the driving member, and the fit portion of the attracted portion is provided at the axis of the driven member.

4. The drive transmission device according to claim 2, wherein one of the fit portions is concave or a projection, and the other of the fit portions is convex or a recess.

5. The drive transmission device according to claim 2, wherein the fit portions slidably contact with each other in the rotational direction when the magnetic force is less than a certain value.

6. The drive transmission device according to claim 1, wherein the second period is before the first period.

7. The drive transmission device according to claim 6, wherein the continuous, substantially constant current causes the attracting portion and the attracted portion to be coupled in such a manner that the driving member and the driven member rotate together.

8. The drive transmission device according to claim 1, wherein the variable current increases gradually.

9. The drive transmission device according to claim 1, wherein the attracted portion includes:

a fixed portion fixed to the driven member; and a movable portion provided around the fixed portion and being axially movable with respect to the fixed portion within a predetermined length and being rotationally fixed to the fixed portion.

10. The drive transmission device according to claim 9, wherein the attracting portion includes:

a first attracting part which is an end of the driving member and faces the driven member; and a second attracting part provided around the first attracting part, the second attracting part being electronically isolated from the first attracting part with a nonmagnetic material provided between the first attracting part and the second attracting part, wherein the controller controls the first attracting part and the second attracting part separately.

11. The drive transmission device according to claim 10, wherein the driving member is a driving shaft.

12. An image forming apparatus comprising:

the drive transmission device according to claim 1.

13. The image forming apparatus according to claim 12, further comprising:

an image forming unit configured to form a developer image;

an image transfer unit configured to transfer the developer image from the image forming unit to a medium; and a fixing unit configured to fix the developer image to the medium.

14. The image forming apparatus according to claim 13, wherein the image forming unit includes the driving member and the driven member.

15. The image forming apparatus according to claim 13, wherein the image transfer unit includes the driving member and the driven member.

16. An image forming apparatus comprising:

a drive transmission device including;

a driving member configured to rotate by a first electric current and having an attracting portion configured to generate magnetic force by a second electric current;

a driven member having an attracted portion, the attracted portion facing the driving member and configured to be attached to the attracting portion by the magnetic force, so that the driven member integrally rotates with the driving member when the attracting portion is coupled to the attracted portion; and a controller configured to control the first electric current and the second electric current, the controller configured to apply the first electric current and the second electric current, an image forming unit configured to form a developer image;

an image transfer unit configured to transfer the developer image from the image forming unit to a medium; and a fixing unit configured to fix the developer image to the medium, wherein, wherein the fixing unit includes the driving member and the driven member.

17. A method of controlling a drive transmission device comprising the steps of:

rotating a driving member by applying a first electric current; and magnetically attaching a driven member to the driving member by applying a second electric current, after the driving member starts rotating, wherein the second electric current includes a first time period in which the second electric current is a continuous, substantially constant current and a second time period in which the second electric current is a variable current caused by an intermitted voltage.

18. The method according to claim 17, wherein the second time period is before the first period.

19. The drive transmission device of claim 1, wherein the continuous, substantially constant current is sufficient to cause the attracting portion to completely couple with the attracted portion so that the driving member and the driven member rotate together.

* * * * *